US007241024B2

(12) United States Patent
Kindberg

(10) Patent No.: US 7,241,024 B2
(45) Date of Patent: Jul. 10, 2007

(54) UTILITY LIGHT THERMAL IMPACT SHELL

(76) Inventor: Carl G. Kindberg, 79 Saint John St., Palmer, MA (US) 01069

( * ) Notice: Subject to any disclaimer, the term of this patent is extended or adjusted under 35 U.S.C. 154(b) by 0 days.

(21) Appl. No.: 10/846,964

(22) Filed: May 14, 2004

(65) Prior Publication Data

US 2005/0254235 A1 Nov. 17, 2005

(51) Int. Cl.
*F21S 6/00* (2006.01)

(52) U.S. Cl. ..... 362/186; 362/374; 362/185; 362/320

(58) Field of Classification Search ..... 362/240, 362/223, 225, 247, 249, 368, 186
See application file for complete search history.

(56) References Cited

U.S. PATENT DOCUMENTS 2,861,711 A * 11/1958 Schneider ..... 220/830
2,923,429 A * 2/1960 Schneider ..... 220/263
4,141,062 A * 2/1979 Trueblood ..... 362/400
5,453,920 A * 9/1995 Eubanks ..... 362/376
5,984,490 A * 11/1999 Leen ..... 362/240

* cited by examiner

*Primary Examiner*—Sandra O'Shea
*Assistant Examiner*—Anabel Ton
(74) *Attorney, Agent, or Firm*—James F. Baird

(57) ABSTRACT

Apparatus used with a screen, an inner wall and a standard utility light fixture. The shell is made from a material that is flexible, acting as a shock absorber in the event the apparatus is dropped or strikes a hard surface. The shell is separated from the inner wall, except at contact points, to permit the passage of air thereby dissipating heat, has a hook extending therefrom to use to suspend the apparatus, a plurality of extensions that are shaped to form hinges to engage the screen and an eyelet to receive a latch on said screen. The screen permits light to pass through, and has a latch protruding therefrom. The inner wall being sized and shaped to house a standard light bulb, having a bottom, formed to securely engage said light fixture, and a plurality of contact points for securing the inner wall to the shell.

5 Claims, 3 Drawing Sheets

UTILITY LIGHT THERMAL IMPACT SHELL

BACKGROUND

The field of my invention is work lights of the type typically used by mechanics at vehicle repair shops. The invention portrayed is an improved work light enclosure. Mechanics have used work light to provide light in hard to see places either under the vehicle, under the hood, in the engine compartment or inside the passenger area. The mechanic needs the light to see the part that is being worked on and often observe other component parts in the immediate area. The conventional work lights that are available typically have a metal enclosure and screen that house the light bulbs.

The light bulb generates a great amount of heat and causes the metal enclosure and screen to heat up. The heat is sufficient to cause damage to plastic, or fabric of the vehicle, that the work light is resting against. The heat is also sufficient to cause burns or injury to the mechanic or others who may accidently touch the work light enclosure. In many work situations the mechanic will find that face, hands, tools, work light and part or parts being worked on are all in a very confined space. The likelihood of injury in such a situation is great.

In addition to the foregoing the normal use of such a Utility Light often results in the light being dropped on the floor or struck against a wall or other hard surface. The sudden impact of the Utility Light often results in the filament of the bulb that is either lit or out to fracture and break resulting in the bulb not functioning. The use of a flexible outer surface would act as a shock absorber reducing the impact on the light filament. I have made several prototypes and found that the use of an outer shell that is made of a flexible material that is spaced from the inner lining allows for heat dissipation and a shock absorbing feature. The result is that the outer shell does not overheat and the filament does not fracture in the event of impact.

The present invention provides an improved portable, safe work light enclosure that does not allow its outer surface to heat up.

An object of the invention is to provide a work light enclosure that is light weight, portable and with an outer surface that does not heat up.

A yet further object of the invention is to incorporate an outer surface that is made of a flexible material that acts as a shock absorber in the event of any impact.

SUMMARY OF THE INVENTION

The invention portrayed is a new and improved enclosure for work lights. There is a need for this device as conventional work lights heat up during use. The light bulb within the enclosure generates a great amount of heat and as a result the enclosure reaches high temperatures, high enough to cause burns to a mechanics face hands or arms. The heat is also sufficient to melt plastic, carpeting, rubber or other items that the enclosure comes in contact with. In addition work lights bulb filaments tend to fracture upon even the slightest impact, especially in the event the work light is dropped on the floor or is struck against a hard object.

My invention utilizes an enclosure with a double wall construction. The inner wall provides support for the bulb fixture and reflects light through a protective screen to the work area. A second outer wall, or shell, is secured to and spaced from the inner wall. The shell is secured to the inner wall at a plurality of contact points. The spacing between the shell and inner wall is such as to allow air to circulate thru the space thereby dissipating the heat. I found that an ideal space was between ⅛th and ¼th inch. A greater space could be used however the resulting increase in dimensions could cause the entire apparatus to become too large for the typical work situation. A smaller spacing was found to restrict air movement and reduce heat dissipation and defeat this purpose of the double wall.

I further found that by the use of flexible material for the shell it became a shock absorber and eliminated the fracturing of the light filament in the event the apparatus was dropped on the floor or struck a hard object. I found that the use of flexible plastic, rubber or fiberglass for the shell produced the desired result. The fact the shell was spaced from the inner wall created the shock absorber effect.

The shell and inner wall are separated at the bottom of the enclosure allowing maximum air entry. In a similar fashion the inner wall and shell are separated at the top to allow maximum air to exit.

The bottom surface of the inner wall provides a means for securing the apparatus to the light bulb fixture. A typical means is to form a band around the light bulb fixture and be secured with a nut and bolt.

The inner surface of inner wall has a reflective surface with the light bulb fixture being positioned in the enclosure in order that light is reflected and directed at the work area. The position is such that side glare from the bulb is eliminated.

While the invention will be discussed in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

BRIEF DESCRIPTION OF THE DRAWINGS

The object and features of the invention may be understood with reference to the following detailed description of an illustrative embodiment of the invention, taken together with the accompanying drawings in which.

DESCRIPTION OF THE PREFERRED EMBODIMENT

Figure 1:
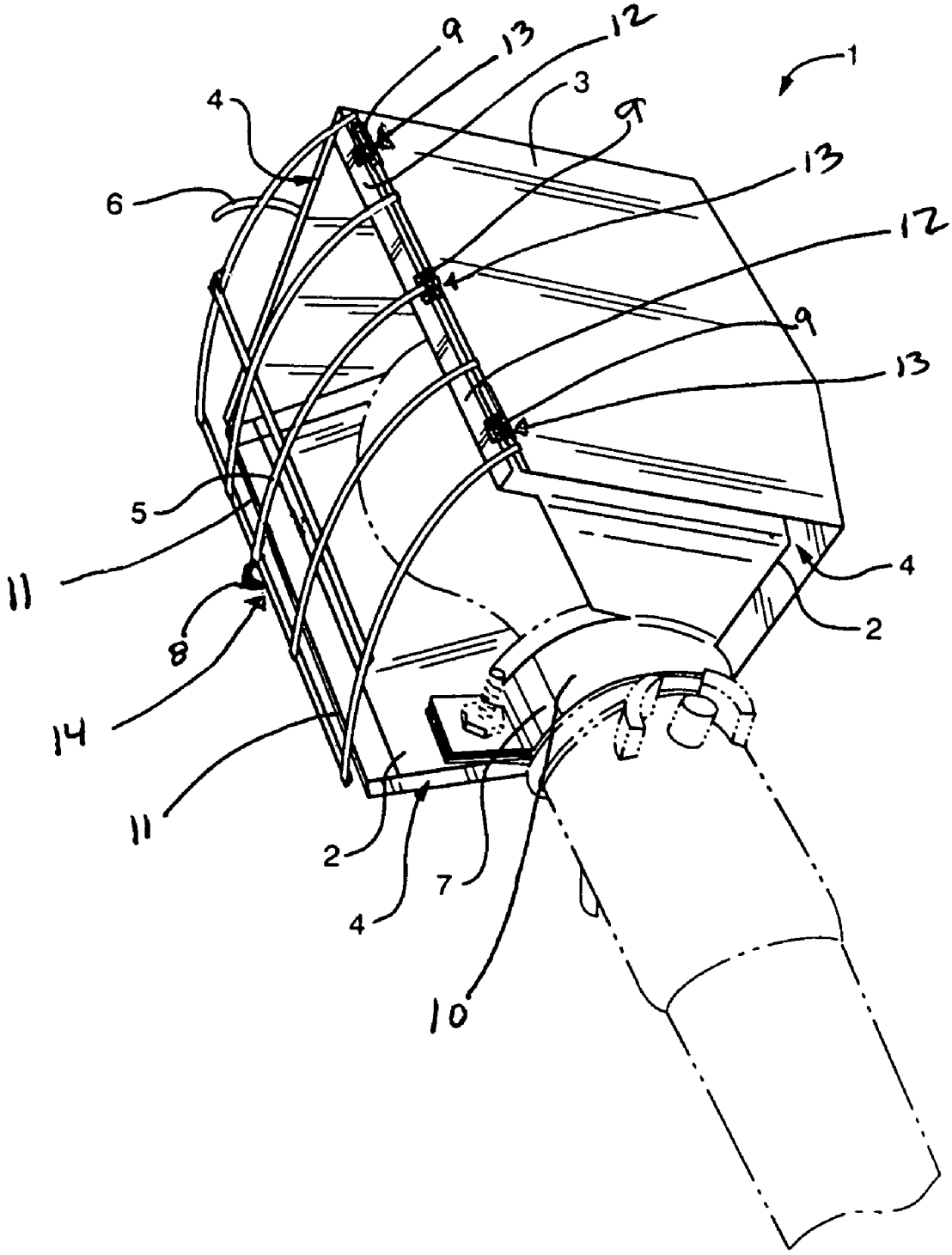
FIG. 1 is a perspective view of the invention, UTILITY LIGHT THERMAL IMPACT SHELL 1 showing inner wall 2, Shell 3, air space (between the inner wall and the outer wall) 4, screen 5, support hook 6, latch hook 8, extensions to receive screen 9 and means for securing the apparatus to the light bulb fixture 7. In addition shown are partial lip 10, first contact surface 11, second contact surface 12, extensions on the second contact surface 13 and hook receptacle 14.

Turning first to FIG. 1 there is shown the present invention, UTILITY LIGHT THERMAL IMPACT SHELL. FIG. 1 is a perspective view of the invention, showing the Shell 3, Inner Wall 2, Space between the Shell and Inner Wall 4, Screen 5, Support Hook 6, latch hook 8, extensions to receive screen 9 and Means to secure the Apparatus to the light bulb fixture 7. The light bulb fixture is shown in dotted lines. In addition shown are partial lip 10, first contact surface 11, second contact surface 12, extensions on the second contact surface 13 and hook receptacle 14.

Figure 2:
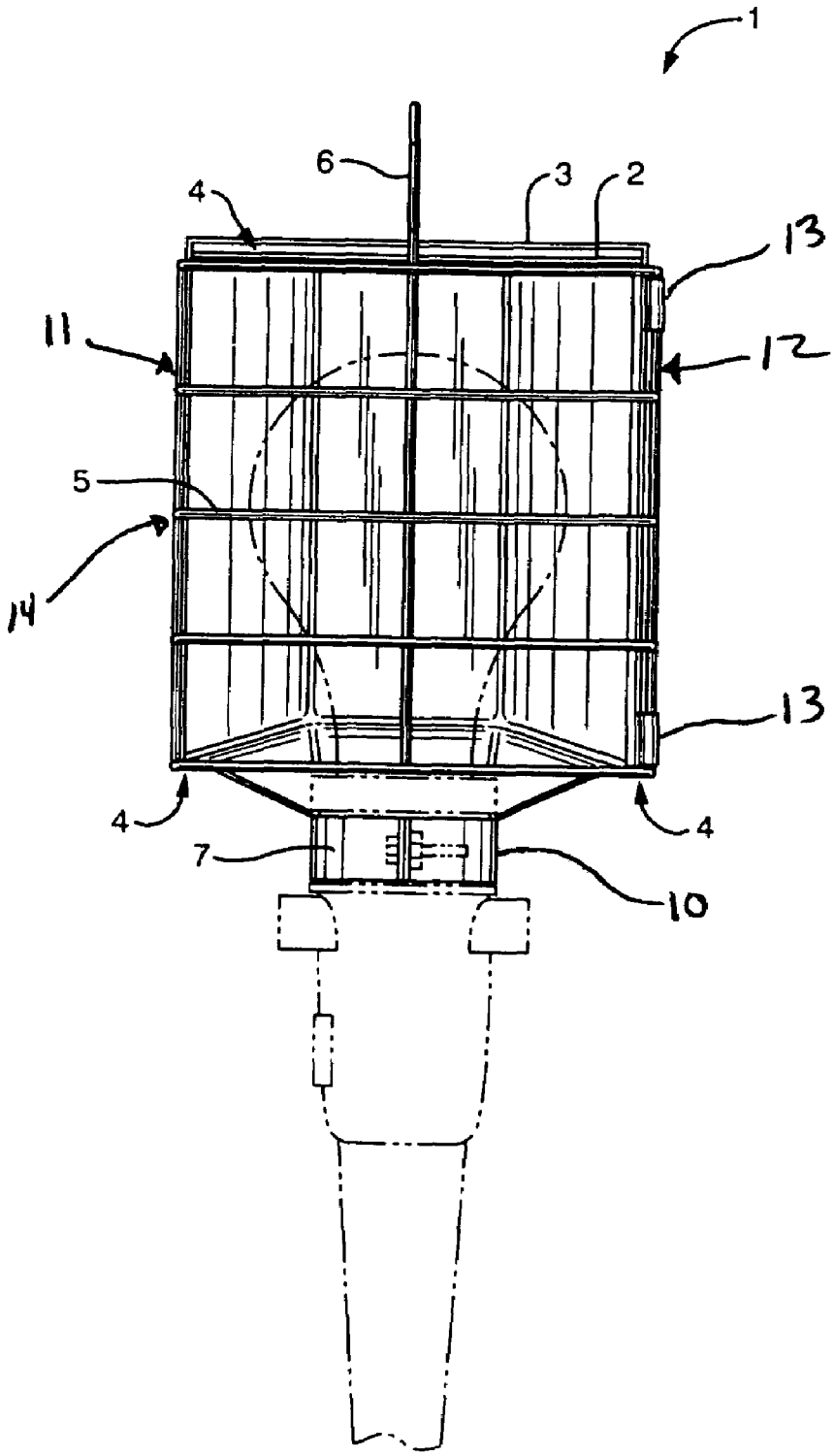
FIG. 2 is a front view of the invention and shows the light bulb fixture in dotted lines. Shown are also inner wall 2, Shell 3, air space 4, screen 5, support hook 6 and means for securing the apparatus to the light bulb fixture 7, shown in dotted lines is a nut and bolt. In addition shown are partial lip 10, first contact surface 11, second contact surface 12, extensions on the second contact surface 13 and hook receptacle 14.

FIG. 2 is a front view of the invention and shows the Shell 3, Inner Wall 2, Space between the Shell and Inner Wall 4, Screen 5, Support Hook 6 and Means to secure the Apparatus to the light bulb fixture 7. The light bulb fixture is shown in dotted lines. In addition shown are partial lip 10, first contact surface 11, second contact surface 12, extensions on the second contact surface 13 and hook receptacle 14.

Figure 3:
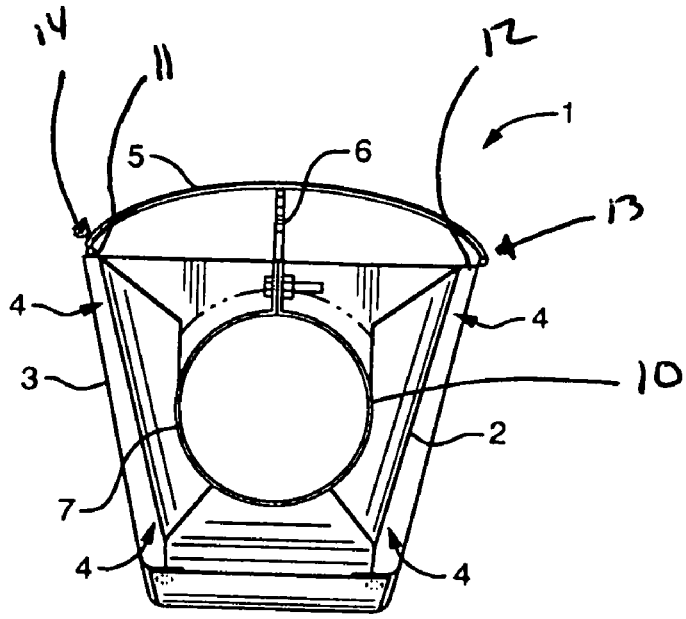
FIG. 3 is a bottom view of the UTILITY LIGHT THERMAL IMPACT SHELL 1, also shown are inner wall 2, Shell 3, air space 4, screen 5, support hook 6 and means for securing the apparatus to the light bulb fixture 7. In addition shown are partial lip 10, first contact surface 11, second contact surface 12, extensions on the second contact surface 13 and hook receptacle 14.

FIG. 3 is a bottom view of the invention and shows the Shell 3, Inner Wall 2, Space between the Shell and Inner Wall 4, Screen 5, Support Hook 6 and Means to secure the Apparatus to the light bulb fixture 7. In addition shown are partial lip 10, first contact surface 11, second contact surface 12, extensions on the second contact surface 13 and hook receptacle 14.

Figure 4:
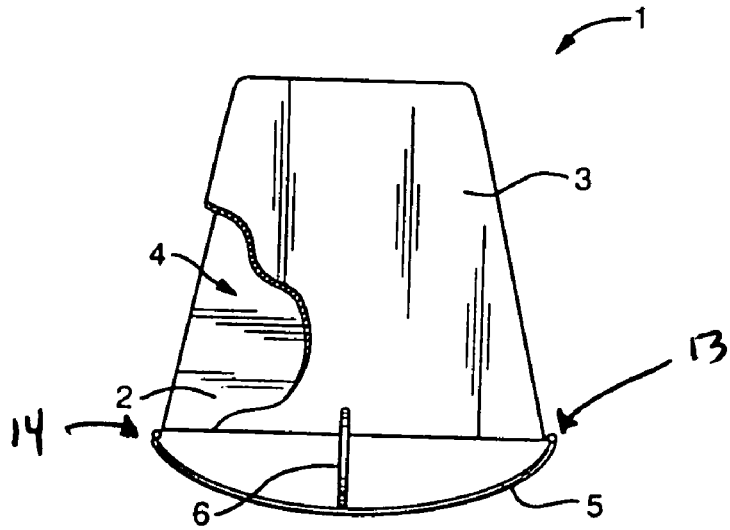
FIG. 4 is a top view of the UTILITY LIGHT THERMAL IMPACT SHELL 1, with a partial cutaway shown are inner wall 2, Shell 3, air space 4, screen 5 and support hook 6. In addition shown are extensions on the second contact surface 13 and hook receptacle 14.

FIG. 4 is a top view of the invention with a partial cutaway and shows the Shell 3, Inner Wall 2, Space between the Shell and Inner Wall 4, Screen 5 and Support Hook 6. In addition shown are extensions on the second contact surface 13 and hook receptacle 14.

The Shell 3, is made of a flexible material such as plastic, rubber or fiberglass. From the foregoing description it will be apparent that modifications can be made to the apparatus without departing from the teaching of the present invention. Accordingly, it is distinctly understood that the invention is not limited to the preferred embodiment but may be embodied and practiced within the scope of the following claims.

I claim:

1. Utility Light Thermal Impact Shell used in conjunction with a single incandescent light bulb fixture comprising:

a.) a first member being a screen with a plurality of openings of sufficient size to permit light to pass through, said screen having a height and width such that the screen is rectangular in shape, said screen having a first height side and a second height side with a latch hook extending from the first height side and with a plurality of extensions that are shaped to form screen hinges extending from the second height side;

b.) an inner wall being concave and sized and shaped to house said light bulb fixture, said inner wall having a top width dimension, a bottom width dimension, said bottom width dimension being formed to provide a partial lip being a means for securely engaging said light bulb fixture, a left height dimension and a right height dimension, said left height dimension being extended to form a first contact surface, said right height dimension being extended to form a second contact surface, said first contact surface having a hook receptacle to receive said screen latch hook, said second contact surface having a plurality of extensions sized and shaped to receive said screen hinges; and c.) a Shell being convex and sized and shaped to fixedly engage with said inner wall only at the first contact surface and the second contact surface, the Shell being separated from the remainder of the inner wall by a uniform distance, said Shell having a support hook extending therefrom, said Shell being made from a flexible material, said flexible material being a non metal from the group of flexible materials that includes plastic, rubber and fiberglass.

2. Utility Light Thermal Impact Shell used in conjunction with a light bulb fixture as described in claim 1 further comprising:

where the uniform distance between the inner wall and the Shell is not less than ⅛th inch and not more than ¼th inch.

3. Utility Light Thermal Impact Shell used in conjunction with a light bulb fixture as described in claim 1 further comprising:

where the inner wall is made of a material that has a highly reflective surface.

4. A Utility Light heat dissipation tunnel used in conjunction with a single incandescent light bulb fixture comprising:

a.) a first member being a screen with a plurality of openings of sufficient size to permit light to pass through, said screen having a height and width such that the screen is rectangular in shape, said screen having a first height side and a second height side with a latch hook extending from the first height side and with a plurality of extensions that are shaped to form screen hinges extending from the second height side;

b.) an inner wall being concave and sized and shaped to house said light bulb fixture, said inner wall being a reflector, said inner wall having a top width dimension, a bottom width dimension, said bottom width dimension being formed to provide a partial lip being a means for securely engaging said light bulb fixture, a left height dimension and a right height dimension, said left height dimension being extended to form a first contact surface, said right height dimension being extended to form a second contact surface and c.) a Shell being convex and sized and shaped to fixedly engage with said inner wail only at the first contact surface and the second contact surface, the Shell being separated from the remainder of the inner wall by a uniform distance, said distance being not less than ⅛th inch and not greater than ¼th inch, said Shell having a support hook extending therefrom, said Shell being made from a flexible material, said Shell having a hook receptacle where the Shell makes contact with the inner wall first contact surface to receive the screen latch hook and said Shell having a plurality of extensions where the Shell makes contact with the inner wall second contact surface to receive said screen hinges.

5. A combined Utility light heat dissipation tunnel and impact shock absorber used in conjunction with a single incandescent light bulb fixture comprising:

a.) a first member being a screen with a plurality of openings of sufficient size to permit light to pass through, said screen having a height and width such that the screen is rectangular in shape, said screen having a first height side and a second height side with a latch hook extending from the first height side and with a plurality of extensions that are shaped to form screen hinges extending from the second height side;

b.) an inner wall being concave and sized and shaped to house said light bulb fixture, said inner wall being a reflector, said inner wall having a top width dimension, a bottom width dimension, said bottom width dimension being formed to provide a partial lip being a means for securely engaging said light bulb fixture, a left height dimension and a right height dimension, said left height dimension being extended to form a first contact surface, said right height dimension being extended to form a second contact surface, said first contact surface having a hook receptacle to receive said screen latch hook, said second contact surface having a plurality of extensions sized and shaped to receive said screen hinges; and c.) a Shell being convex and sized and shaped to fixedly engage with said inner wall only at the first contact surface and the second contact surface, the Shell being separated from the remainder of the inner wall by a uniform distance, said distance being not less than ⅛th inch and not greater than ¼th inch, said Shell having a support hook extending therefrom, said Shell being made from a flexible material, said flexible material being a non metal from the group of flexible materials that includes plastic, rubber and fiberglass.

* * * * *